US009328992B1

(12) United States Patent
Smith et al.

(10) Patent No.: US 9,328,992 B1
(45) Date of Patent: May 3, 2016

(54) METHOD AND APPARATUS FOR GUN STABILIZER

(71) Applicants: Johnny Lee Smith, Cullman, AL (US); Roy Manley, Vinemont, AL (US)

(72) Inventors: Johnny Lee Smith, Cullman, AL (US); Roy Manley, Vinemont, AL (US)

( * ) Notice: Subject to any disclaimer, the term of this patent is extended or adjusted under 35 U.S.C. 154(b) by 0 days.

(21) Appl. No.: 14/541,300

(22) Filed: Nov. 14, 2014

(51) Int. Cl.
*F41A 29/00* (2006.01)
*F41C 27/22* (2006.01)

(52) U.S. Cl.
CPC ..... *F41C 27/22* (2013.01)

(58) Field of Classification Search
USPC ..... 42/94; 211/64; 242/385.4, 329, 354.1; 248/330.1
See application file for complete search history.

(56) References Cited

U.S. PATENT DOCUMENTS

| | | | | |
|---|---|---|---|---|
| 1,051,914 | A | 2/1913 | Prochnow | |
| 1,446,058 | A | 2/1923 | Neilly | |
| 2,481,884 | A | 9/1949 | Short | |
| 5,009,022 | A | 4/1991 | McCoy | |
| 5,738,328 | A * | 4/1998 | O'Farrill | F16M 13/04 24/170 |
| 6,112,448 | A | 9/2000 | Gray et al. | |
| 7,930,851 | B1 | 4/2011 | Woolsey | |
| 8,316,572 | B2 | 11/2012 | Saunders | |
| 2006/0137233 | A1 | 6/2006 | Meeks | |
| 2009/0064560 | A1 * | 3/2009 | Saunders, III | F41C 33/001 42/94 |
| 2012/0255976 | A1 | 10/2012 | Dees | |

FOREIGN PATENT DOCUMENTS

| | | |
|---|---|---|
| DE | 1.291.065 | 3/1969 |
| GB | 113512 | 2/1918 |

* cited by examiner

*Primary Examiner* — J. Woodrow Eldred
(74) *Attorney, Agent, or Firm* — George L Williamson

(57) ABSTRACT

Method and apparatus for a firearm stabilizer having a housing for mounting onto a firearm from which housing a cord extends having a connector on its distal end so that the connector can be removably attached to a proximate stable object during firing wherein the cord is wound on a spring-loaded spindle disposed inside the housing. An edge of the spindle extends through an opening on either side wall of the housing so that a hand of the user can contact and tension the spindle thereby tightening the cord so as to stabilize the firearm while firing the weapon.

28 Claims, 6 Drawing Sheets

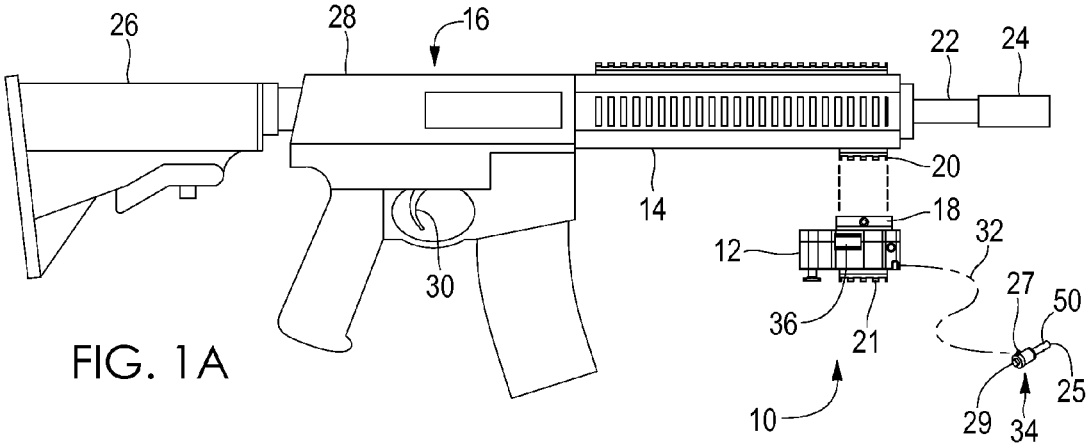
FIG. 1A
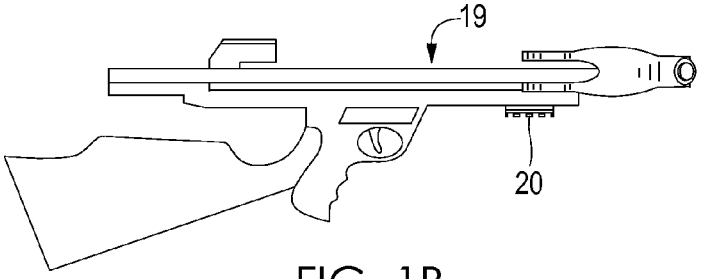
FIG. 1B
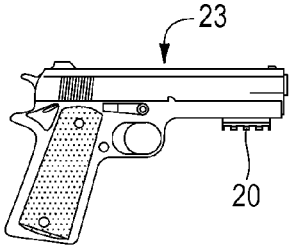
FIG. 1C
FIG. 2
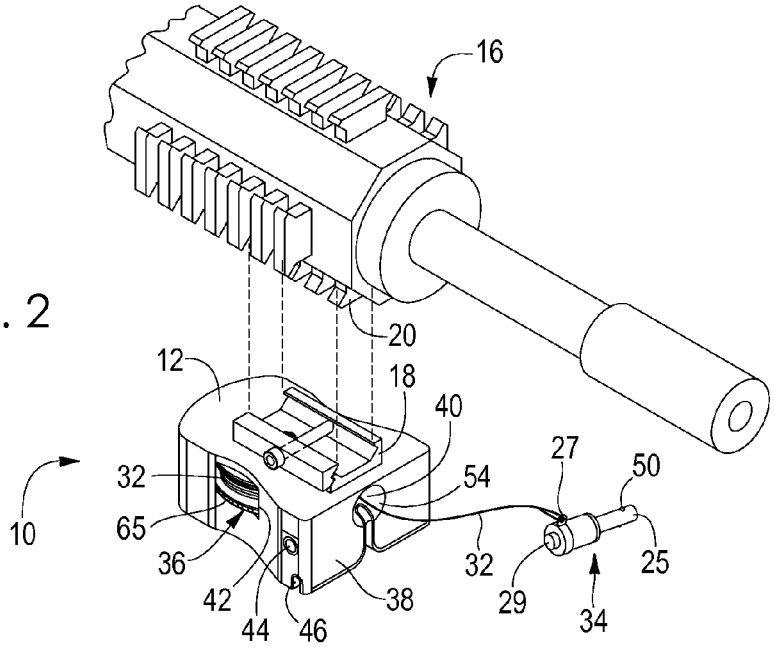

METHOD AND APPARATUS FOR GUN STABILIZER

BACKGROUND OF THE INVENTION

1. Field of the Invention

The present invention relates generally to firearm accessories and, more particularly, is concerned with a stabilizing system for a firearm.

2. Description of the Related Art

Firearm stabilizers have been described in the related art, however, none of the related art devices disclose the unique features of the present invention.

In U.S. Pat. No. 1,051,914, dated Feb. 4, 1913, Prochnow disclosed a strap support for guns. In U.S. Pat. No. 1,446,058 dated Feb. 20, 1923, Neilly disclosed a clasp for use with a firearm. In U.S. Pat. No. 2,481,884 dated Sep. 13, 1949, Short disclosed a combination arm band and rifle sling. In U.S. Pat. No. 5,009,022 dated Apr. 23, 1991, McCoy disclosed a gun safety assembly. In U.S. Pat. No. 5,738,328 dated Apr. 14, 1998, McCoy disclosed a multiple use stabilizer lanyard with stirrup. In U.S. Pat. No. 6,112,448 dated Sep. 5, 2000, Gray, et al., disclosed a firearm forearm sling and method of use of same. In U.S. Pat. No. 7,930,851 dated Apr. 26, 2011, Woolsey disclosed a firearm strap tensioner. In U.S. Pat. No. 8,316,572 dated Nov. 27, 2012, Saunders disclosed a suspended gun rest. In U.S. Patent Application Publication 2006/0137233 dated Jun. 29, 2006, Meeks disclosed a stabilizing apparatus and method. In U.S. Patent Application Publication 2012/0255976 dated Oct. 11, 2012, Dees disclosed a rifle sling with stabilizing loop. In British Patent GB113,512 dated Feb. 28, 1918, Folvary disclosed an improved apparatus for carrying light machine guns and the like in firing positions. In German Patent No. DE1,291,065 dated Mar. 20, 1969, Haefner disclosed a rifle sling.

The suspended gun rest described in U.S. Pat. No. 8,316,572, does not provide the operator with the ability to shoot from the kneeling or prone positions. This device suspends the firearm only and does not provide the operator the options of utilizing anchored line tension to stabilize the firearm. Also, this device must be connected only to overhead objects to operate unlike the present invention. The present invention is far more versatile and allows use of the following positions: single-line down, lateral single-line, single-line off shoulder, single-line off waist); wrapping cord/line around a vertically oriented object to stabilize the firearm (lateral loop); standing an unloaded condition-safe rifle against a vertically oriented object and securing the firearm with cord/line to the object (secure line). These are illustrated in Examples One-Nine of the present patent application.

While these firearm accessories may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a firearm stabilizer having a housing mounted underneath the forearm of a firearm from which housing a cord extends having a connector on its distal end so that the connector can be removably attached to a proximate stable object, for example, an overhead object or the foot of the user, during firing, wherein the cord is wound on a spring-loaded spindle disposed inside the housing. An important feature of the present invention includes an edge of the spindle extending through an opening on either side wall of the housing so that a hand of the user can contact and tension the spindle thereby tightening the cord so as to stabilize the firearm while firing the weapon.

Using a firearm, particularly a rifle, has two critical challenges that must be overcome. First, a shooter/user must establish a stable shooting platform in order to take a precise shot. Second, a shooter must maintain vertical and horizontal mobility in order to acquire a moving or alternate target. These challenges must be overcome while providing the shooter with the versatility to shoot from the standing, kneeling, sitting and prone positions. Any device used to overcome these challenges must be small, strong, light, easy to deploy and operate and must attach to the rifle in a simple but secure manner. The device must also meet these challenges without necessarily being anchored to secondary objects such as, trees, tree limbs, posts, etc., because the operator may find himself standing in the open with no proximate object to which he can attach.

Current and past devices such as bipods, tripods and shooting sticks are limited in their vertical and horizontal mobility. This is based largely on the fact that they are placed on top of a support, such as the ground, and must be picked up and moved horizontally for substantial horizontal movement of the target. The same can be said of vertical movement of the target. Some of these devices must be carried separately by the shooter as they do not mount to the rifle.

An advantage of the present invention is that it is useful for many purposes, e.g., suspending a firearm from an elevated support while increasing stability and maintaining vertical and horizontal mobility; attaching a firearm to a vertical support while increasing stability and maintaining vertical and horizontal mobility; utilizing anchored line tension for stability and maintaining vertical and horizontal mobility and securing an unloaded firearm against a vertically oriented support as will be further explained in Examples One-Nine of the present patent application. Current and past devices do not allow for the following wide array of uses as does the present invention which include the following: 1) Overhead Loop; 2) Single-line Up; 3) Single-line Down; 4) Single-line Off the Waist; 5) Single-line off the shoulder; 6) Lateral Single-line; 7) Lateral Loop; 8) Prone Foothold; and 9) Secure Line.

An object of the present invention is to stabilize a firearm while it is being fired. A further object of the present invention is to a housing of a firearm stabilizer for placement under the barrel of a firearm so that a portion of a spindle internal the housing can be controlled by the hand of a user to stabilize a firearm during the firing process. A further object of the present invention is to provide a cord extending from a housing on the firearm so that the cord can be wrapped around a proximate object to stabilize the firearm during the firing process. A further object of the present invention is to provide a firearm stabilizer which can be removably attached to a firearm. A further object of the present invention is to provide a firearm stabilizer which can be used for numerous shooting positions. A further object of the present invention is to provide a firearm stabilizer which can be easily operated by a user of the firearm. A further object of the present invention is to provide a firearm stabilizer which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 1A is side view of the present invention shown in operative connection.

FIGS. 1B-1C are side views of alternative embodiments of the present invention.

FIGS. 2-3 are perspective views of the present invention.

LIST OF REFERENCE NUMERALS

Figure 3:
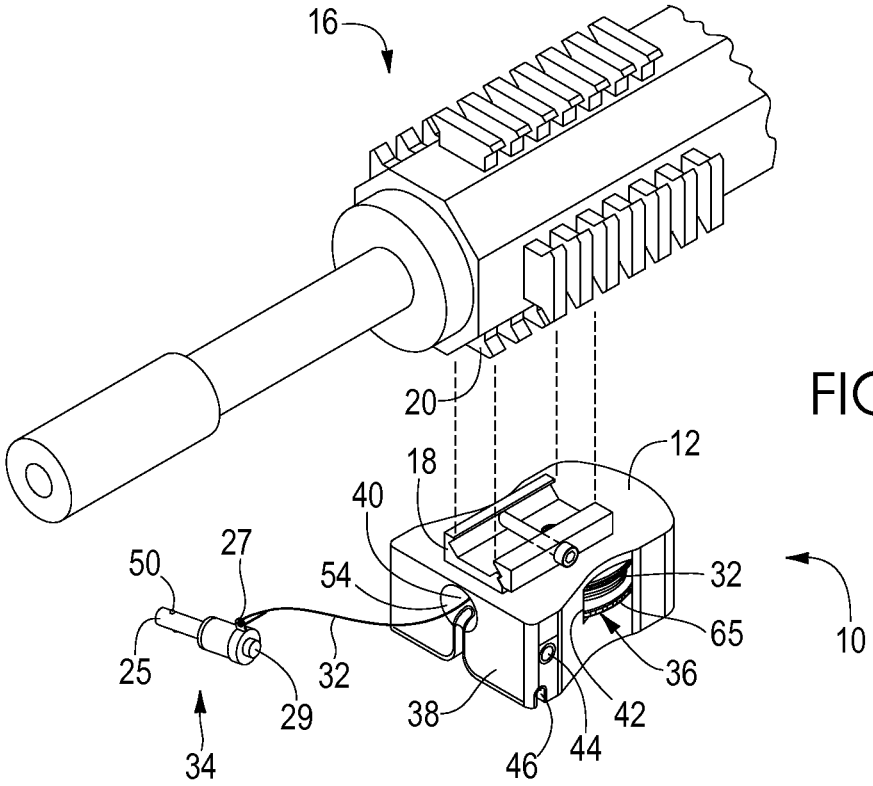

With regard to reference numerals used, the following numbering is used throughout the drawings.

10 present invention
12 housing
14 forearm
16 rifle
17 bore
18 female piccatinny rail
19 crossbow
20 piccatinny rail
21 piccatinny rail
22 barrel
23 handgun
24 muzzle
25 pin portion
26 stock
27 ring portion
28 receiver
29 button portion
30 trigger
32 cord/line
34 connector
36 spindle
37 overhanging lip
38 front wall
39 pathway/conduit
40 outlet aperture on front of housing
41 front inner wall
42 opening for thumb wheel
44 pin receptacle
46 lateral opening
48 front slot
50 ball
52 enlarged end of receptacle
54 countersink
56 female portion
58 bolt portion
60 bottom half of housing
62 top half of housing
63 spool of spindle for cord
64 thumb wheel portion of spindle
65 serrated edge/grooves
66 bearing
68 axle/arbor
69 vertical slot
72 lock pin
74 locator pin
75 protrusion
76 locator pin
78 cord pin/torque spring pin
80 40-40 BHCS
82 mylar strip/tab
84 pic clamp
92 axle spring
94 lock spring
96 spiral spring
98 6-32 SHCS axle bolt
100 10-32 SHCS
102 alignment pin
104 8-32 SHCS for clamp
106 user
107 hand and fingers
108 body of carabiner
110 gate of carabiner
112 overhead object
113 lateral object
114 ring
116 cup
117 hole for connector pin
118 carabiner adapter
119 eyelet receiving hole
120 loop of cord
122 waist belt
124 waist
126 strap
128 shoulder support side
130 shooting side foot

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1A through 17 illustrate the present invention wherein a firearm stabilizer is disclosed and which is generally indicated by reference number 10.

Turning to FIG. 1A, therein is shown the present invention 10 having a housing 12 mounted under the forearm 14 of a rifle 16 using mating conventional piccatinny rails 18, 20, or the like, commonly used on firearms, having one female piccatinny rail 18 disposed on the top portion of housing 12 and a second or mating piccatinny rail 20 disposed on the rifle wherein the rifle has a barrel 22, muzzle 24, a stock 26, a receiver 28 and a trigger 30. The housing 12 has a cord/line 32 which extends from its front end and having a connector 34 mounted onto the distal end of the cord/line 32. Also shown is a thumb wheel portion of a spindle shown generally at 36 protruding slightly through the side wall of the housing 12. Connector shown generally at 34 is a conventional quick release ball detent pin having a pin portion 25, a ring portion 27 for connection of cord 32 thereto, a button release portion 29 and a ball portion 50. The housing 12 of the gun stabilizing device of the present invention 10 mounts to the conventional military standard 1913 rail 20 on the bottom of a rifle 16 beneath the front stock and/or hand guard; a handgun underneath the barrel; or, a crossbow underneath the front grip. The device housing 12 has a front, rear, left and right side. It is constructed of anodized aluminum and measures approximately 2.5" wide, 3" in length and 1.25" high. When mounted, the front-end of the housing 12 points in agreement with or coaxially with the muzzle 24 of the weapon 16. A Mil-STD-1913 rail connector 18 is affixed to the top of the housing 12 for receiving a Mil-STD-1913 rail. A Mil-STD-1913 rail 21 is also affixed to the bottom of the housing 12 for attaching a light, bipod or other device to the bottom of the gun stabilizing device.

By reference to FIG. 1A, it should be understood that the present invention 10 has right side and left side portions defined with respect to its centerline which substantially corresponds with the centerline of barrel 22 of rifle 16 as would be commonly defined and understood from the perspective of the operator or shooter holding the stock 26 and facing toward the muzzle 24 of the rifle 16. The top or upper portion of housing 12 is oriented toward the rifle 16 and the bottom or lower portion of the housing is oriented toward the ground.

Turning to FIGS. 1B-1C, therein are show alternative weapons in the form of a handgun 23 and crossbow 19 each having a piccatinny rail 20 mounted thereon for receiving the housing 12 of the present invention 10 as illustrated in FIG. 1A. It would be understood by one skilled in the art that the present invention 10 could be mounted on virtually any type weapon or firearm, especially, if a piccatinny rail or the like was mounted on the weapon, e.g., long gun, rifle, shotgun, handgun, crossbow.

Turning to FIG. 2, therein is shown a right side of the rifle 16 and the right side of housing 12 exploded away from the rifle showing the mating piccatinny rails 18, 20 on both the housing and the lower part of the rifle. Also shown is a line/cord 32 carried or wound on spindle 36 extending from the front wall 38 of the housing having an outlet 40 on the front of the housing and a connecting pin 34 on the distal end of the cord/line. Also shown is an opening 42 in the right side of the housing through which the serrated edge of the thumb wheel portion 65 of the spindle 36 is exposed making it easily accessible to the hand of a user. Also shown is a pin receptacle 44 or hole in the side wall of the housing 12 along with a lateral pathway or opening 46 through which the cord/line 32 can extend along with a front vertical slot 48 located in the front wall 38 of the housing 12. Countersink area 54 is also shown. Connector 34 is a conventional quick release ball detent pin having a pin portion 25, a ring portion 27 for connection of cord 32 thereto, a button release portion 29 and a ball portion 50.

Turning to FIG. 3, therein is shown the left side of rifle 16 and left side of housing 12 exploded away from the rifle showing the mating piccatinny rails 18, 20 on both the housing and the lower pan of the rifle. All elements previously disclosed are shown from the right side of the present invention 10.

Figure 4:
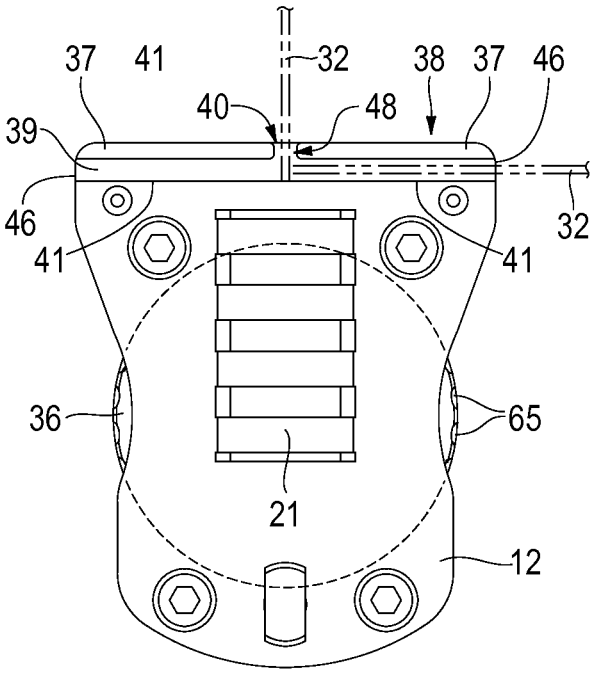
FIG. 4 is a bottom view of the present invention.
Figure 5:
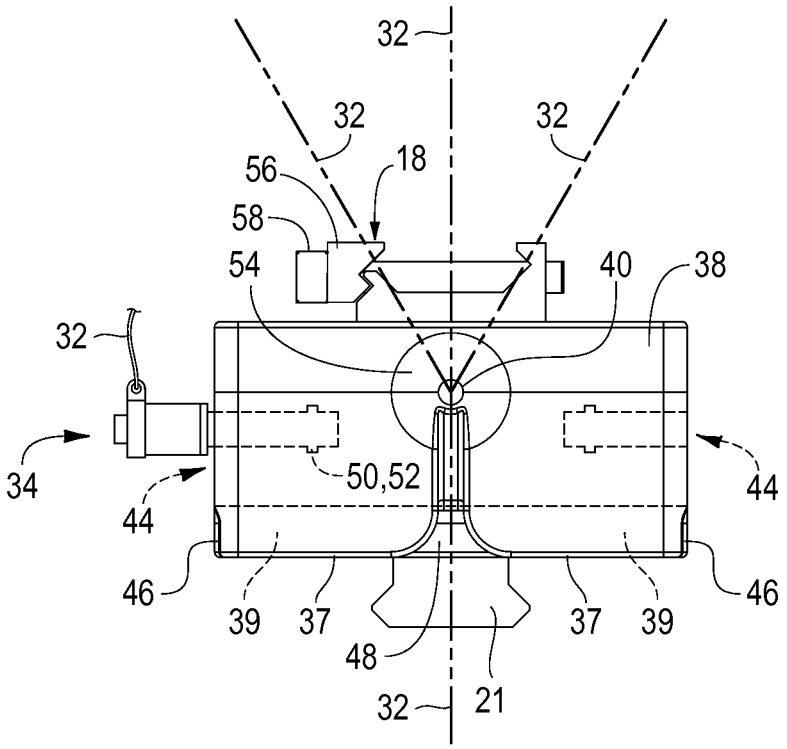
FIGS. 5-6 are front views of the present invention.
Figure 6:
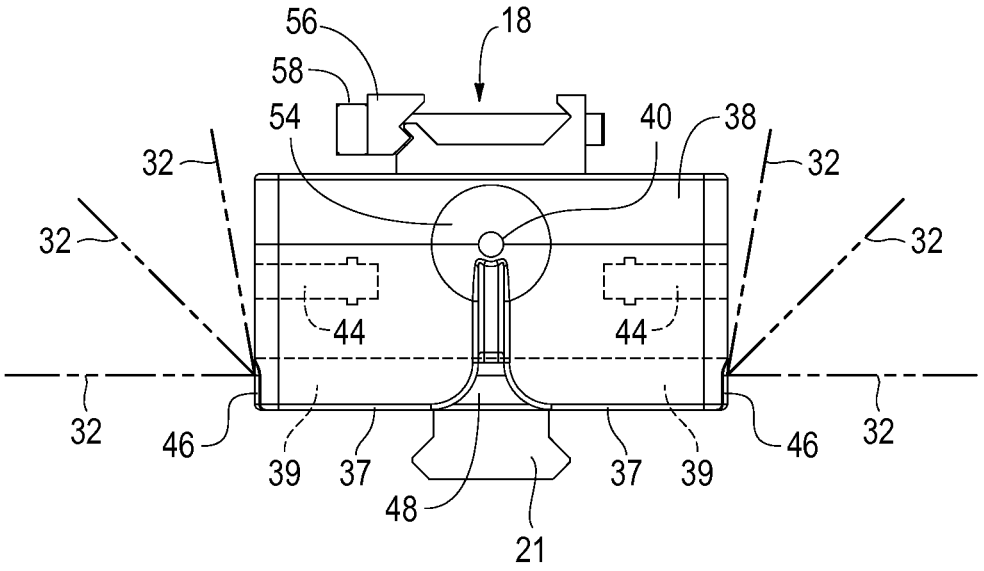

Turning to FIG. 4, therein is shown a bottom view of housing 12 along with some previously disclosed elements. Also shown are the horizontal lateral openings 46 on each side of the housing 12 along with the vertical front slot 48 which allows the line 32 to extend downwardly from the housing 12. The front face or wall 38 of the housing 12 (as best shown in FIGS. 5-6) has an aperture 40 through which the cord 32 passes. Adjacent to the slot 48 are laterally extending and opposing overhanging lips 37 behind which the cord 32 may be routed through and captured by a conduit-like pathway 39 bounded by a front inner wall 41 and the forwardly projecting, downwardly extending, overhanging lips 37 which pathway is open on its bottom portion and extends from the left to the right side of the bottom of housing 12. The cord 32 (shown in phantom line) may be routed out the front (shown as vertically in FIG. 4), or, to the right or to the left depending on the user selected direction.

Turning to FIG. 5, therein is shown a front view of the housing 12 showing numerous previously disclosed elements. Also shown are the receptacles 44 on each side of the housing 12 wherein each receptacle extends inwardly toward the center of the housing for receiving a connecting pin 34 wherein the balls 50 of the connecting pin fit inside an enlarged area 52 inside housing 12 on the end of the receptacle 44 disposed toward the center of the housing 12 to removably lock connecting pin 34 to the housing. Also shown is the outlet aperture 40 of the housing 12 wherein the outlet 40 is surrounded by a countersink area 54 which allows the cord/line 32 to exit smoothly from the front wall 38 of the housing so that the line/cord 32 can be extended and retracted from the spindle contained internal the housing 12. Also shown are the horizontal lateral openings 46 on each side of the housing 12 along with the vertical front slot 48 which allows the line 32 to extend downwardly from aperture 40 of the housing 12. Also shown are overhanging lips 37 (shown in hidden line) and pathway 39. The cord/line 32 is shown extending from multiple positions to illustrate that the line can exit from the opening 40 and countersink area 54 in a 360 degree fashion from any angle around the front wall 38 of the housing 12. Also shown on top of the housing are the components of the piccatinny rail portion 18 attached to top of housing 12 including a female portion 56 and a bolt portion 58. Another piccatinny rail 21 is disposed on the bottom of housing 12 for attachment of accessories thereto.

Turning to FIG. 6, therein is shown a view similar to FIG. 5. Also shown is cord 32 extending in multiple directions from the lateral openings 46 on each side of the housing 12. The cord/line 32 is shown extending from multiple positions to illustrate that the line can exit from the aperture 40 and countersink area 54 in a 360 degree manner from any angle around the front wall 38 of the housing 12.

The importance of line/cord 32 extending in multiple directions from housing 12, as shown in FIG. 5-6, will be illustrated in Example One-Nine.

Figure 7A:
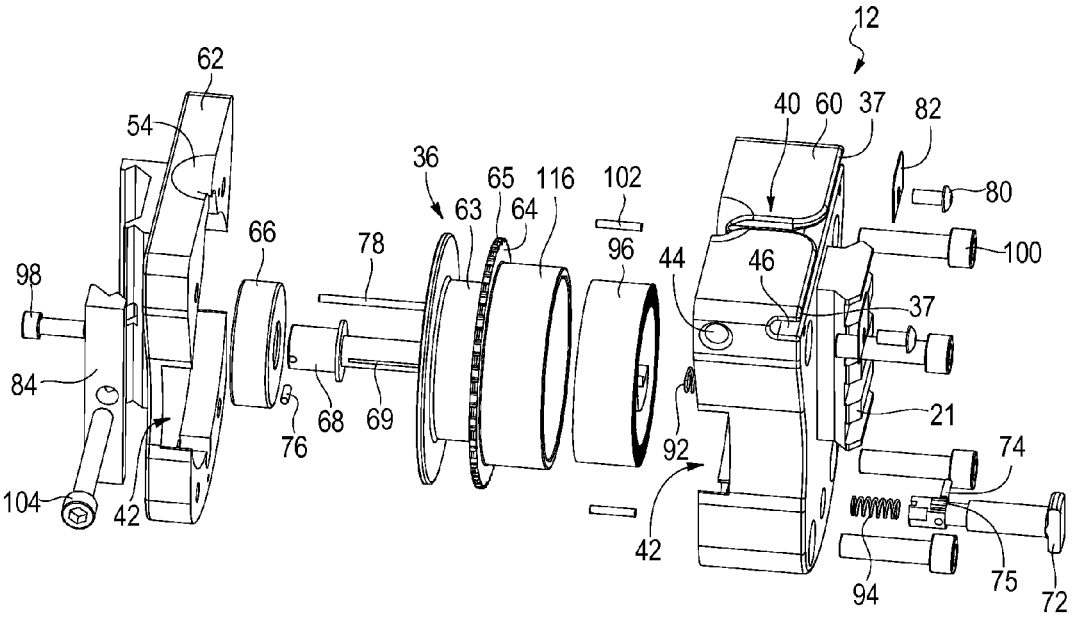
FIGS. 7A-7B are exploded views of the present invention.
Figure 7B:
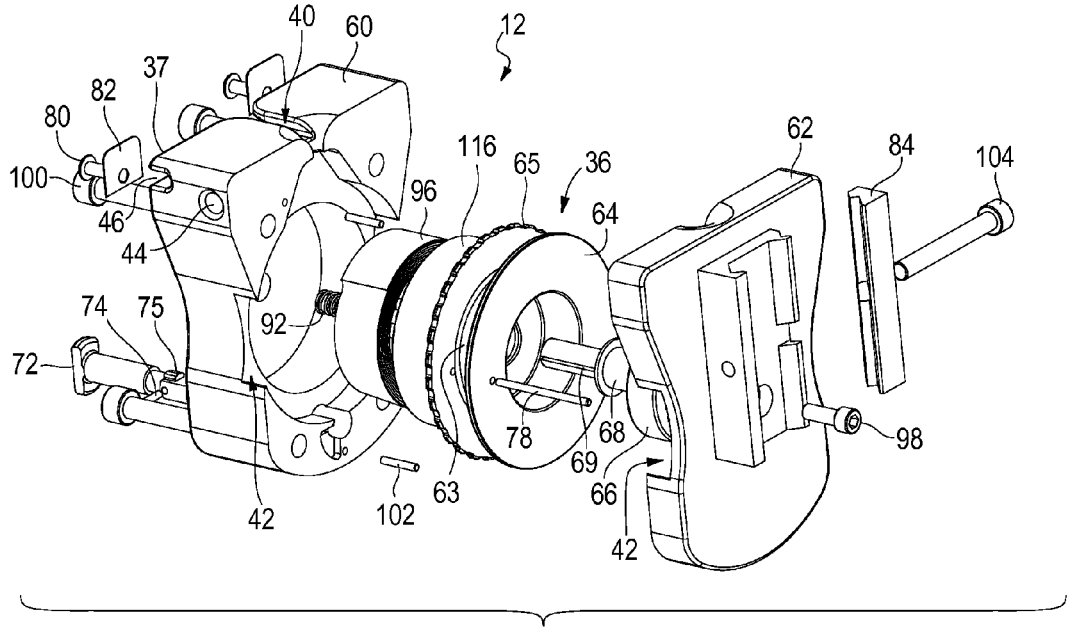

Turning to FIGS. 7A-7B, therein are shown exploded views of the housing 12 of the present invention 10 showing the bottom half 60, the thumb wheel 64, top half 62, bearing 66, axle 68, lock pin 72, locator pin 74, locator pin 76, cord pin/torque spring pin 78, 40-40 BHCS (button head cap screw) 80, mylar strip 82, pick clamp 84, carabiner adapter 118, axle spring 92, lock spring 94, spiral torsion or torque spring 96, SHCS (socket head cap screw) axle 98, SHCS 100, alignment pin 102, SHCS or clamp 104 and receptacle 44. Inside the housing 12 is a spindle shown generally at 36 having a spool 63 upon which cord 32 (not shown) is wound and an exposed thumb wheel portion 64 with grooved or serrated edges 65 for being controlled or manipulated by the hands of a user. The diameter of the thumb wheel 64 is slightly greater than the width of the device housing 12 so that openings 42 on both left and right sides of the device housing 12 allow the edges of the thumb wheel to protrude or extend beyond each side wall of the housing and this feature allows for the following: the spool 64 to be gripped by the operator's thumb and index finger to stop the thumb wheel's rotation once the desired firearm elevation or tension on the cord is achieved; allows the operator to manually take up line slack not taken up by the action of the retraction spring 96; and, allows for easy installation of new cord/line when needed. (The grooves 65 on the edge of the thumb wheel 64 are engaged by the primary locking mechanism.)

Affixed to the bottom of the spool 63 of the spindle 36 and inside the housing 12 is a cup 116 (open-side down) that houses a constant-force/spiral torsion spring 96. Once the cord/line 32 wound on spool 63 is extended the spring 96 acts to retract the cord. This spring 96 can be disengaged to replace the cord/line 32. The spring 96 attaches to the inside of the cup 116 via a vertically mounted pin 78 wherein one end of the spring is anchored to the pin. The spool/thumb wheel 64 rotates on a spline/arbor 68 affixed at the center of the housing 12 containing cord/line 32 on spool 63. (One embodiment uses 12 feet of 0.90 mm, 201 lb. test cord 32.) The cord/line 32 extends out the front of the housing 12 through outlet hole 40 having countersink 54 area around the hole.

The arbor 68 is cylindrical in shape and is situated in a vertical position relative to the housing 12 located at the center of the housing. The arbor 68 passes centrally through the spool/thumb wheel 64 and has a secondary support hole in the bottom housing. The lower half of arbor 68 has a vertical slot 69 that engages the torque spring 96 center to hold it stationary while in use and the opposite end of the arbor extends into the upper housing through a bearing 66 and supports the majority of the radial load. On the top end of the arbor 68, a pin 76 is pressed in the side at a 90 degree angle during assembly and this pin locks the arbor into a stationary position while in use and can disengage for reloading cordage 32. A compression spring 92 housed in the lower housing support-hole will force upward pressure on arbor 68 to make it engage into the upper housing groove (not shown) and this groove in the upper housing prevents the arbor from spinning while in use. A bolt 98 is screwed into the top of the arbor 68 to prevent the pin 76 from disengaging from the upper housing groove (not shown). The spool/thumb wheel 64 can rotate counter clockwise around the bearing 66 and generate radial force causing retraction of cordage 32 on the spool/thumb wheel. To facilitate changing cord/line 32, a bolt 98 is removed from the top of the arbor 68. A 5/32 hexagonal wrench fits into the top of the arbor 68 so that pressing down and turning can either release or add tension as needed.

The primary locking mechanism is located on the rear bottom-side of the housing 12 wherein the lock bolt 72 is situated in a vertical position relative to the housing 12 running perpendicular to the edges of the spool 64 so that the handle portion of the bolt 72 extends out the bottom side of the housing 12. The lock bolt 72 is cylindrical in shape and moves up and down within a cylindrical opening or hole inside the upper and lower portions of the device housing 12. When the lock bolt 72 is in the down position, a protrusion 75 on the bolt engages one of the many grooves 65 on the edge of the spool 64 prohibiting spool/thumb wheel rotation. When the lock bolt 72 is in the up position, the protrusion 75 on the bolt cannot engage the grooves 65 on the spool 64 and the spool is free to turn. A spring 94 is inserted above the lock bolt 72 to apply constant downward pressure on the bolt to keep the bolt in place once locked. At the top of the bolt 72 is a pin 74 extending at a perpendicular angle from the bolt. When the bolt 72 is pushed upward and rotated, the pin 74 enters a slot in the bolt that prevents the bolt from sliding downward and back into the locked position.

The cord/line 32 that exits the device housing 12 is attached to a stainless steel quick release ball detent connector pin 34 (not shown); pin receiver holes 44 designed to accept the connector pin 34 are located near the front end of the device housing 12 on both the left and right sides. Other previously disclosed elements may also be shown.

Figure 17:
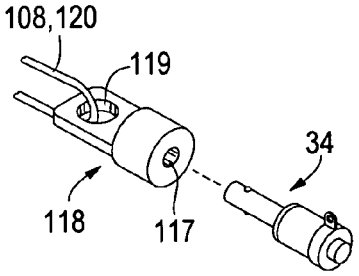
FIG. 17 is a perspective of a portion of the present invention.

Turning to FIG. 17, to create more options (i.e., positions) for using the present invention 10, a carabiner adapter 118 has been designed having a first end being cylindrical in shape for about half of its length and having a receiver hole 117 on its terminus for accepting the connector pin 34. The second end tapers from the first end forming a flattened end having a hole/eyelet 119 passing therethrough and being flattened and designed to receive a carabiner 108 or other hanging apparatus such as a loop of cord 120. This allows the cord/line 32 to be anchored to various types of different objects. Also, a loop of cord 120 can be formed and can be passed through the hole 119 for anchoring to various types of different objects.

Examples One-Nine follow and show additional details and examples of using the present invention 10 and may make reference to elements found in FIG. 1A-17. Also, in Examples One-Nine, when a loop of cord 120 is required, a carabiner adapter 118 will normally be required so that the connector 34 can be connected to the loop of cord or other similar object. Examples One (FIG. 8), Two (FIG. 9) and Three (FIG. 10) show options using various types of connections including a carabiner 110, a carabiner adapter 118, and a loop of cord 120.

Example One

Figure 8:
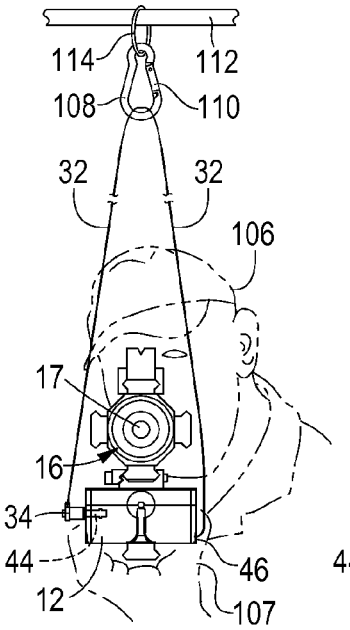
FIGS. 8-16 are illustrations of options for using the present invention.

See FIG. 8; Overhead Loop.

By way of general discussion and with reference to FIG. 8, therein is shown an example of a shooting position wherein is shown a user 106 holding a rifle 16 having a bore 17 thereon in the fingers of the hands 107 having the housing 12 of the present invention 10 attached underneath the rifle 16 as previously disclosed. Cord 32 extends upwardly from one side (the left side) of the housing 12 over the carabiner body 108 or the like having a gate 110 thereon and the line 32 extending downwardly back toward the housing 12 so that the connector 34 can be placed into the pin receptacle 44 of the right side of the housing so as to lock the connector in place. The carabiner body 108 is attached to an overhead object 112 using a ring 114 or the like.

Set-up: First, the operator 106 will need to locate a stable object 112 overhead to which a carabiner 108 can be attached, e.g., onto an auto bumper, fence, railing, door hinge, nail, screw, branch of a tree, a cord wrapped branch, etc.

Next, with the carabiner 108 attached overhead, the connector pin 34 end of the cord/line 32 is directed laterally out the lateral opening 46 on the bottom side of the front of the housing 12 and then overhead through a carabiner 108 and then attached to the opposite side of the device housing 12. Both sides of the device housing 12 are designed to accept the connector pin 34 to facilitate left and right handed shooting. Cord 32 slides easily through the carabiner 108 because it is expected to be made of smooth metal, e.g., stainless steel, or it might also have a pulley thereon.

Next, as the muzzle of the weapon 16 is pointed downward, cord/line 32 is played out or extended. As the muzzle of the weapon 16 is raised, cord/line 32 slack will be taken out automatically by the spring action spindle 64 provided the primary lock 72 is disengaged and the thumb wheel 65 is not grasped or contacted.

Purpose: The operator 106 can move the weapon 16 vertically and horizontally with ease. The operator 106 can control or squeeze the thumb wheel 65 with his fingers to hold the weapon 16 at the desired position and shoot if desired. The operator 106 also may decide to engage the primary lock 72 to rest, wait, change magazines, glass the target area or utilize communications, etc.

Positions Supported: Standing, kneeling, sitting and prone.

Example Two

Figure 9:
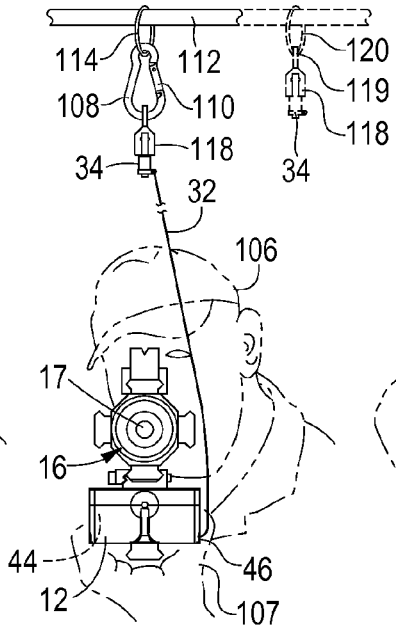

See FIG. 9; Single-line Up. Only Option 1 is illustrated.

Set-up:

Option 1: First, the operator 106 will need to locate a stable object 112 overhead to which a carabiner 108 can be attached; e.g., auto bumper, fence, metal railing, door hinge, nail, screw, branch, cord wrapped branch, etc.)

Next, the operator 106 will insert the connector pin 34 into the carabiner adapter 118 and insert a carabiner 108 into the receiving hole 44 in the carabiner adapter 118.

Next, the operator 106 will extend the cord/line 32 out the front of the housing 12 and upward or route the cord/line laterally under either the left or right lateral opening 46 on the bottom side of the front of the housing 12 and then upward.

Next, the operator 106 will connect the carabiner 108 to the selected stable object 112 above the rifle 16.

Option 2: First, the operator 106 will need to locate a stable object 112 overhead to which a loop of cord 120 can be attached; e.g., an auto bumper, fence, metal railing, door hinge, nail, screw, branch, cord wrapped branch, etc.). Note, use of a loop of cord 120 normally requires use of a carabiner adapter 118.

Next, the operator 106 will secure a loop of cord 120 into the receiving hole 119 in the carabiner adapter 118.

Next, the operator 106 will connect this same loop of cord 120 to the selected stable object 112 above the firearm 16 to which the loop of cord can be connected.

Next, the operator 106 will insert the connector pin 34 into the carabiner adapter 118.

Next, as the muzzle 24 of the weapon 16 is pointed downward, cord/line 32 is extended out and as the muzzle of the weapon is raised, cord/line slack will be taken out automatically by the spring action of the spindle 64 provided the primary lock 72 is disengaged and the thumb wheel 65 is not grasped by hand 107.

Purpose: The operator 106 can move the weapon 16 vertically and horizontally with ease. The operator 106 can contact the thumb wheel 65 to hold the weapon 16 at the desired position and shoot if desired. The operator 106 may also decide to engage the primary lock 72 to rest, wait, change magazines, glass the target area, utilize communications, etc.

Positions Supported: Standing, kneeling, sitting and prone.

Example Three

Figure 10:
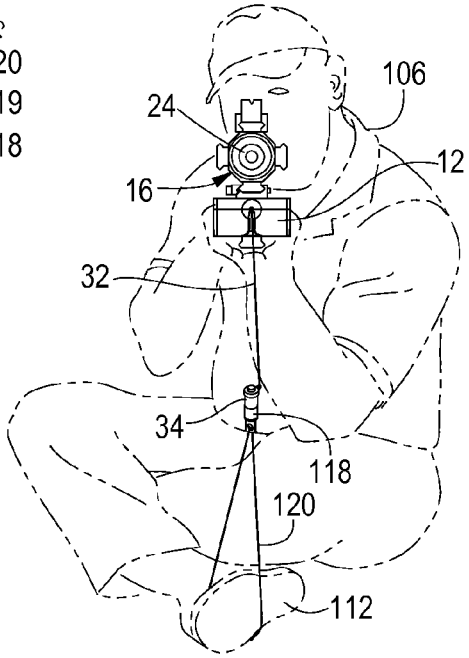

See FIG. 10; Single-line Down. Only Option 2 is illustrated.

Set up:

Option 1: First, the operator 106 will need to locate a stable object 112 beneath the rifle 16 to which a carabiner 108 can be attached; e.g., an auto bumper, fence, metal railing, door hinge, nail, screw, branch, a cord wrapped branch, operator's foot, etc.).

Next, the operator 106 will insert the connector pin 34 into the carabiner adapter 118 and insert a carabiner 108 into the receiving hole 119 in the carabiner adapter.

Next, the operator 106 will attach the carabiner 108 to the selected stable object 112 below the rifle 16. Cord/line 32 slack will be taken out automatically by the spring action of the spindle 64.

Option 2: First, the operator 106 will need to locate a stable object 112 beneath the rifle 16 to which a loop of cord 120 can be attached; e.g., auto bumper, fence, metal railing, door hinge, nail, screw, branch, a cord wrapped branch, the operator's foot, etc.). Note, use of a loop of cord 120 normally requires use of a carabiner adapter 118.

Next, the operator 106 will secure the loop of cord 120 into the receiving hole 119 in the carabiner adapter 118.

Next, the operator 106 will attach the carabiner adapter 118 using the loop of cord 120 to the selected stable object 112 below the rifle 16.

Next, the operator 106 will insert the connector pin 34 into the carabiner adapter 118. Cord/line slack 32 will be taken out automatically by the spring action of the spindle 64 provided the primary lock 72 is disengaged and the thumb wheel 65 is not grasped.

Purpose: The operator 106 can move the weapon 16 vertically and horizontally with ease. To stabilize the weapon 16, the operator 106 can squeeze or manipulate the thumb wheel 65 with hand 107 and pull the weapon upward until the cord/line 32 is tight. The operator 106 may also decide to engage the primary lock 72 and pull the weapon 16 upward until the cord/line 32 is tight. The weapon 16 is stabilized as tension is applied to cord 32 and the tension is transmitted along its length. Also, the muzzle 24 rise due to recoil when the weapon 16 is fired is greatly reduced.

Positions supported: Standing, kneeling, sitting and prone.

Example Four

Figure 11:
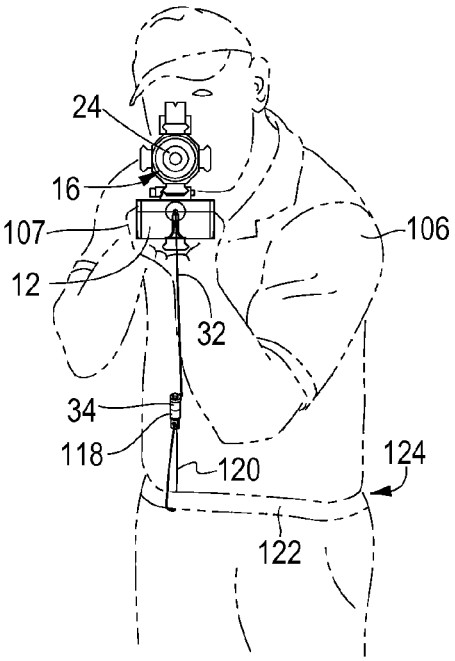

See FIG. 11; Single-line off Waist. Only Option 2 is illustrated.

Set Up:

Option 1: First, the operator 106 will insert the connector pin 34 into the carabiner adapter 118 and insert a carabiner 108 into the receiving hole 119 in the carabiner adapter.

Next, the operator 106 will connect the carabiner 108 to his or her waist belt 122 at the front or sides of the waist 124. Line 32 slack will be taken out automatically by the spring action of the spindle 64.

Option 2: First, the operator 106 will secure a loop of cord 120 into the receiving hole 119 in the carabiner adapter 118. Next, the operator 106 will connect this same loop of cord 120 to his or her waist belt 122 at the front or sides of the waist. This secures the carabiner adapter 118 to the operator's waist 124. Note, use of a loop of cord 120 normally requires use of a carabiner adapter 118.

Next, the operator 106 will insert the connector pin 34 into the carabiner adapter 118.

Cord 32 will extend off spindle 64 and as the muzzle 24 of the weapon 16 is raised, cord/line slack will be taken out automatically by the spring action of the spindle provided the primary lock 72 is disengaged and the thumb wheel 65 is not grasped.

Purpose: The operator 106 can move the weapon 16 vertically and horizontally with ease. To stabilize the weapon 16, the operator 106 can squeeze the thumb wheel 65 with his thumb and index finger of hand 107 or with only one finger on one or both sides of thumb wheel 65 and pull the weapon upward until the cord/line 32 is tight. The operator 106 may also decide to engage the primary lock 72 and pull the weapon 16 upward until the cord/line 32 is tight. (Stability is created by tension along the length of the cord/line 32.) Also, muzzle 24 rise due to recoil when the weapon 16 is fired is greatly reduced.

Positions Supported: Standing, kneeling, sitting and prone.

Example Five

Figure 12:
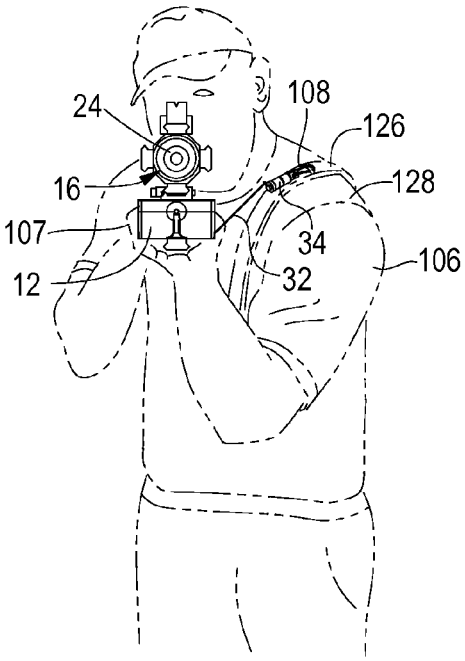

See FIG. 12; Single-line off the Shoulder. Only Option 1 is illustrated.

Set-up:

Option 1: First, the operator 106 will insert the connector pin 34 into the carabiner adapter 118 and insert a carabiner 108 into the receiving hole 119 in the carabiner adapter.

Next, the operator 106 will connect the carabiner 108 to his or her backpack strap 126, vest strap, pack frame over his support side (off gun side) shoulder 128. Line slack will be taken out automatically by the spring action of the spindle 64.

Option 2: First, the operator 106 will secure a loop of cord 120 into the receiving hole 119 in the carabiner adapter 118. Next, the operator 106 will connect the carabiner adapter 118 using the loop of cord 120 to his or her backpack strap 126, vest strap, pack frame over his support side (off gun side) shoulder 128. Note, use of a loop of cord 120 normally requires use of a carabiner adapter 118.

Next, the operator 106 will insert the connector pin 34 into the carabiner adapter 118.

Next, as the muzzle 24 of the weapon 16 is pointed downwardly, cord/line 32 is extended out. As the muzzle 24 of the weapon 16 is raised, cord/line 32 slack will be taken out automatically by the spring action of the spindle 64 provided the primary lock 72 is disengaged and the thumb wheel 65 is not grasped.

Purpose: The operator 106 can move the weapon 16 vertically and horizontally with ease. To stabilize the weapon 16, the operator 106 can grasp the thumb wheel 65 with hand 107 and push the weapon forward until the cord/line 32 is tight. The operator 106 may also decide to engage the primary lock 72 and pull the weapon 16 upward until the cord/line 32 is tight. (Stability is created by tension along the length of the extended cord/line 32.)

Positions Supported: Standing, kneeling, sitting and prone.

Example Six

Figure 13:
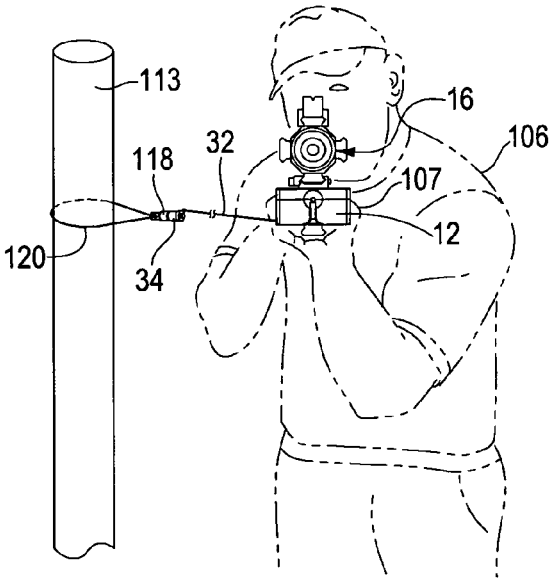

See FIG. 13; Lateral Single-line. Only Option 2 is illustrated.

Set-up:

Option 1: First, the operator 106 will need to locate a laterally situated stable object 113 to which a carabiner 108 can be attached; e.g., an auto bumper, fence, metal railing, door hinge, nail, screw, branch, a cord wrapped branch, etc.) Next, the operator 106 will insert the connector pin 34 into the carabiner adapter 118 and insert a carabiner 108 into the receiving hole/eyelet 119 in the carabiner adapter.

Next, the operator 106 will connect the carabiner 108 to the selected stable object 113 beside the rifle 16 to which the carabiner will connect; e.g., a bumper, fence, metal railing, door hinge, nail, screw, branch, a cord wrapped branch, etc.). Line 32 slack will be taken up automatically by the spring action of the spindle 64.

Option 2: First, the operator 106 will need to locate a laterally situated stable object 113 to which a loop of cord 120 can be attached; e.g., an auto bumper, fence, metal railing, door hinge, nail, screw, branch, a cord wrapped branch, etc.). Note, use of a loop of cord 120 normally requires use of a carabiner adapter 118.

Next, the operator 106 will secure a loop of cord 120 into the receiving hole 119 in the carabiner adapter 118.

Next, the operator 106 will connect the carabiner adapter 118 using the loop of cord 120 to the selected stable object 113 beside the rifle 16 to which the loop of cord 120 can be connected.

Next, the operator 106 will insert the connector pin 34 into the carabiner adapter 118. Cord/line 32 slack will be taken out automatically by the spring action of the spindle 64 provided the primary lock 72 is disengaged and the thumb wheel 65 is not grasped by hand 107.

Purpose: The operator 106 can move the weapon 16 vertically and horizontally with ease. To stabilize the weapon 16, the operator 106 can manipulate the thumb wheel 65 and pull the weapon 16 laterally until the cord/line 32 is tight. The operator 106 may also decide to engage the primary lock 72 and pull the weapon 16 upward until the cord/line 32 is tight. (Stability is created by tension along the length of the extended cord/line 32.)

Positions Supported: Standing, kneeling, sitting and prone.

Example Seven

Figure 14:
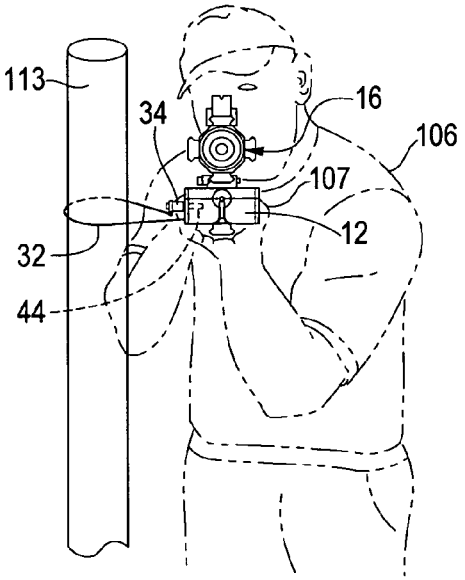

See FIG. 14; Lateral Loop. Only Option 1 is illustrated.

Set-Up:

Option 1: First, the operator 106 will need to locate a vertically oriented object 113 such as a tree or post around which the operator can reach with one arm.

Next, the operator 106 will reach around the object 113 and grasp the connector pin 34 and bring the cord/line 32 completely around the object. The operator 106 will then insert the connector pin 34 into the pin receptacle 44 on the side of the device housing 12. Cord/line 32 slack will be taken out automatically by the spring action of the spindle 64. The operator 106 will then engage the primary locking device 72.

Purpose: The operator 106 will drive his or her weight forward into the shouldered weapon 16. Once the cord/line 32 is forced firmly against the object 113, the weapon 16 will become extremely stable. The operator 106 may also move around the object 113 without disconnecting the connector pin 34. Once in place, the operator 106 may rest, wait, change magazines, glass the target area, utilize communications, etc., provided at least one hand stays on the weapon 16 and forward shoulder pressure is kept on the butt stock of the weapon.

Option 2: First, the operator 106 will need to locate a vertically oriented object 113 such as a tree or post around which the operator can reach with one arm.

Next, the operator 106 will secure a loop of cord 120 into receiving hole 119 in the carabiner adapter 118. Note, use of a loop of cord 120 normally requires use of a carabiner adapter 118.

Next, the operator 106 will reach around the object 113 and grasp inside the loop of cord 120 and bring cord/line 32 completely around the object and engage the primary locking device 72. The operator 106 will adjust the tightness of the cord 32 around the object 113 by pulling the cord with his/her hand. This is a fast deploy method.

Purpose: The operator 106 will drive his or her weight forward into the shouldered weapon 16. Once the line 32 is forced firmly against the object 113, the weapon 16 will become extremely stable. The operator 106 may also move around the object 113 as needed.

Positions Supported: Standing, kneeling, sitting and prone.

Example Eight

Figure 15:
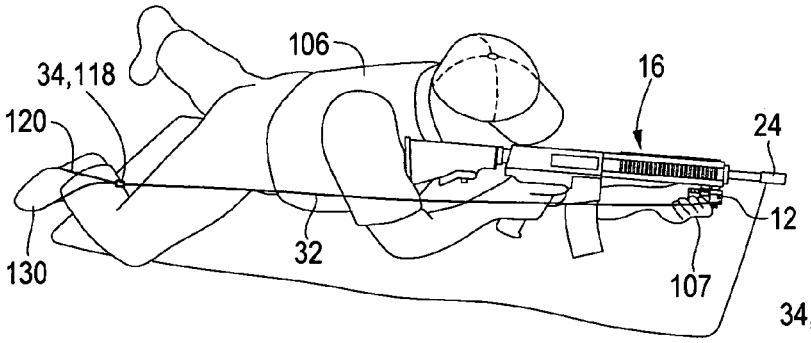

See FIG. 15; Prone Foothold. Only Option 2 is illustrated.

Set-up:

Option 1: First, the operator 106 will insert the connector pin 34 into the carabiner adapter 118 and insert a carabiner 108 into the receiving hole 119 in the carabiner adapter.

Next, the operator 106 will attach the carabiner 108 to his/her strong/shooting-side foot 130. By convention, if the shooter is right handed, the right leg is the strong leg and right hand is strong hand, likewise, the shooting side is the strong side and the opposite or non-shooting side is the support side. Cord/line 32 slack will be taken out automatically by the spring action of the spindle 64.

Option 2: First, the operator 106 will secure the loop of cord 120 into the receiving hole 119 in the carabiner adapter 118. Note, use of a loop of cord 120 normally requires use of a carabiner adapter 118.

Next, the operator 106 will attach the carabiner adapter 118 using the loop of cord 120 to his/her strong/shooting-side foot 130.

Next, the operator 106 will insert the connector pin 34 into the carabiner adapter 118. The operator 106 can now get into the prone shooting position keeping his/her strong-shooting-side leg bent. Cord/line 32 slack will be taken up automatically by the spring action of the spindle 64 provided the primary lock 72 is disengaged and the thumb wheel 65 is not grasped.

Purpose: To stabilize the shouldered weapon 16, the operator 106 can squeeze or manipulate the thumb wheel 65 with his hand 107 and extend his/her strong/shooting-leg back until the cord/line 32 is tight. The operator 106 may also decide to engage the primary lock 72 and extend his/her strong/shooting-leg back until the cord/line 32 is tight. (Stability is created by tension along the length of the extended cord/line 32.) Also, muzzle 34 rise due to recoil when the weapon 16 is fired is greatly reduced.

Positions Supported: Prone.

Example Nine

Figure 16:
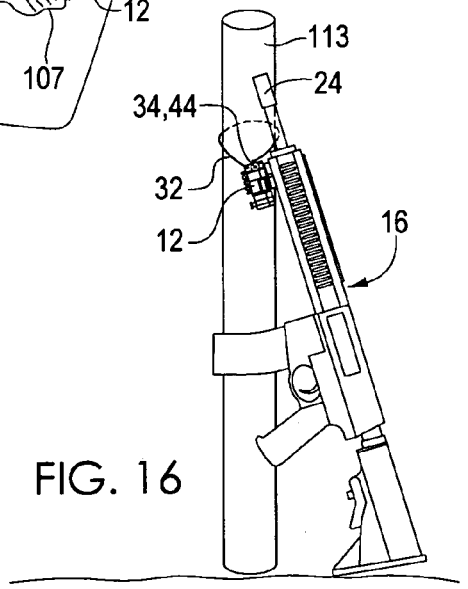

See FIG. 16; Secure Line.

Set Up:

First, the operator 106 will remove all ammunition from the rifle 16 and engage the weapon's safety mechanism.

Next, the operator 106 will need to locate a vertically oriented object 113 such as a tree or post around which the operator can reach with one arm.

Next, the operator 106 will stand the rifle 16 (muzzle 24 up) against the selected object. The operator 106 will then grasp the connector 34 and bring it around the circumference of the selected object 113 and insert the connector into the pin receptacle 44 on the side of the housing 12. Line 32 slack will be taken up automatically by the spring action of the spindle 64.

Next, the operator 106 will activate the primary lock 72.

Purpose: To prevent the rifle 16 from falling over by keeping it upright against the selected object 113.

The following summary of the present invention 10 makes reference to FIGS. 1A-17 as follows: a method for stabilizing a firearm 16 by disposing a housing 12 on the firearm, the housing having a first aperture 40 on a front portion 38 of the housing; providing a rotatable spindle 36 in the housing, the spindle carrying a line 32 having a distal end thereon, and extending the distal end of the line outwardly through the first aperture; biasing the spindle with a spring 96 so that the distal end of the line is biased inwardly; and, attaching the distal end of the line removably to a proximate object 112 for stabilizing the firearm; disposing a connector 34 on the distal end of the line so that the connector is removably attachable to the proximate object for stabilizing the firearm; locking 72 the spindle selectively between a locked position and an unlocked position; providing first and second side portions on the housing, wherein the first side portion has a first receptacle 44 thereon and the second side portion has a second receptacle 44 thereon, wherein the connector is removably attachable to either of the first and second receptacle after the line has been wrapped around the proximate object; providing a first outlet 46 on the first side portion and a second outlet 46 on the second side portion, wherein the distal end of the line is selectively extendable outwardly through either of the first and said second outlet; providing a second aperture 42 on the first side portion and a third aperture 42 on the second side portion, and extending a portion of the spindle through the second and third apertures so that the spindle can be turned by a hand 107 of a user 106; providing a slot 48 extending downwardly from the first aperture to a bottom portion of the housing so that the line can be selectively extended downwardly through the slot; providing a first pathway 39 connecting the slot to the first outlet and a second pathway 39 connecting the slot to the second outlet so that the line can be selectively extended outwardly through either of the first pathway and the first outlet, and the second pathway and the second outlet; disposing the first and second pathways between a downwardly extending overhanging lip 37 on the front portion 38 of the housing and an inner wall 41 of the housing so that the first and second pathways together extend from the first outlet to the second outlet; wherein the spring is a spiral spring; providing serrations 65 on the spindle so that the spindle can be turned by the hand of the user; and, selecting the firearm from the group consisting of a long gun, shotgun, rifle 16, handgun 23 and crossbow 19.

We claim:

1. An apparatus for stabilizing a firearm, comprising:

a) a housing removably mounted on the firearm;

b) a spindle being rotatably disposed internal said housing and including a spool, a line having a distal end being carried on said spool, said distal end of said line extending outwardly through a first aperture in said housing;

c) a retraction spring inside of a circular cup attached to one side of said spool for biasing said spindle so that said distal end of said line is biased inwardly;

d) wherein said distal end of said line is removably attachable to a proximate object for stabilizing the firearm;

e) a thumb wheel mounted on said spindle adjacent to and attached to said cup for an operator to stop rotation of said spindle, said thumb wheel forming a side wall for said spool on which said line winds and unwinds; and, f) a primary locking mechanism located on said housing having a locked position engaging said spindle preventing rotation thereof and an unlocked position in which said spindle is free to rotate.

2. The apparatus of claim 1, further comprising a connector disposed on said distal end of said line for providing the removable attachment.

3. The apparatus of claim 2, wherein said thumb wheel is inside said housing, said housing having an opening to provide access to an outer surface of said thumb wheel.

4. The apparatus of claim 3, further comprising said housing having first and second side portions, said first side portion having a first receptacle thereon and said second side portion having a second receptacle thereon, wherein said connector is removably attachable to said first and said second receptacle after said line is attached to the proximate object.

5. An apparatus for stabilizing a firearm, comprising:

a) a housing disposed on the firearm, said housing having a first aperture therein, said first aperture being disposed on a front portion of said housing;

b) a spindle being rotatably disposed internal said housing, a line having a distal end being carried on said spindle, said distal end of said line extending outwardly through said first aperture;

c) a spring for biasing said spindle so that said distal end of said line is biased inwardly;

d) wherein said distal end of said line is removably attachable to a proximate object for stabilizing the firearm;

e) a connector disposed on said distal end of said line, wherein said connector is removably attachable to the proximate object for stabilizing the firearm;

f) a lock being disposed on said housing for selectively locking said spindle between a locked position and an unlocked position; and, g) said housing having first and second side portions, said first side portion having a first receptacle thereon and said second side portion having a second receptacle thereon, wherein said connector is removably attachable to said first and said second receptacle after said line is attached to the proximate object.

6. The apparatus of claim 5, further comprising said first side portion having a first outlet thereon and said second side portion having a second outlet thereon, wherein said distal end of said line is selectively extendable outwardly through either of said first and said second outlet.

7. The apparatus of claim 6, further comprising said first side portion having a second aperture therein and said second side portion having a third aperture therein, wherein a portion of said spindle extends through said second and third apertures so that said spindle can be turned by a hand of a user.

8. The apparatus of claim 7, further comprising a slot extending downwardly from said first aperture to a bottom portion of said housing so that said line can be selectively extended downwardly through said slot.

9. The apparatus of claim 8, further comprising a first pathway connecting said slot to said first outlet and a second pathway connecting said slot to said second outlet so that said line can be selectively extended outwardly through either of said first pathway and said first outlet, and said second pathway and said second outlet.

10. The apparatus of claim 9, wherein said first and second pathways are disposed between a downwardly extending overhanging lip on said front portion of said housing and an inner wall of said housing so that said first and second pathways together extend from said first outlet to said second outlet.

11. The apparatus of claim 10, wherein said spring is a spiral spring.

12. The apparatus of claim 11, further comprising serrations being disposed on said spindle so that said spindle can be turned by the hand of the user.

13. The apparatus of claim 12, wherein said distal end of said line can be extended outwardly from said housing in a 360 degree arc around said housing and removably attached to the proximate object for stabilizing the firearm.

14. The apparatus of claim 13, wherein said firearm is selected from the group consisting of a long gun, shotgun, rifle, handgun and crossbow.

15. A method for stabilizing a firearm, comprising the steps of:

a) disposing a housing removably on the firearm;

b) providing a rotatable spindle in the housing including a spool, the spool carrying a line having a distal end thereon, and extending the distal end of the line outwardly through a first aperture in said housing;

c) biasing the spindle with a retraction spring inside of a circular cup attached to one side of said spool so that the distal end of the line is biased inwardly;

d) attaching the distal end of the line removably to a proximate object for stabilizing the firearm;

e) providing a thumb wheel on said spindle adjacent to and attached to said cup for an operator to stop rotation of said spindle once a desired firearm elevation or tension on the line is achieved and to allow said operator to manually take up line slack not taken up by action of said retraction spring, said thumb wheel forming a side wall for said spool on which said line winds and unwinds; and, f) providing a primary locking mechanism on said housing having a locked position engaging said spindle preventing rotation thereof and an unlocked position in which said spindle is free to rotate.

16. The method of claim 15, further comprising the step of disposing a connector on the distal end of the line for providing the removable attachment.

17. The method of claim 15, disposing said thumb wheel inside said housing, and providing an opening in said housing to provide access to an outer surface of said thumb wheel.

18. The method of claim 17, further comprising the step of providing first and second side portions on the housing, wherein the first side portion has a first receptacle thereon and the second side portion has a second receptacle thereon, wherein the connector is removably attachable to either of the first and second receptacle after the line is attached to the proximate object.

19. A method for stabilizing a firearm, comprising the steps of:

a) disposing a housing on the firearm, the housing having a first aperture on a front portion of the housing;

b) providing a rotatable spindle in the housing, the spindle carrying a line having a distal end thereon, and extending the distal end of the line outwardly through the first aperture;

c) biasing the spindle with a spring so that the distal end of the line is biased inwardly;

d) attaching the distal end of the line removably to a proximate object for stabilizing the firearm;

e) disposing a connector on the distal end of the line so that the connector is removably attachable to the proximate object for stabilizing the firearm;

f) locking the spindle selectively between a locked position and an unlocked position; and, g) providing first and second side portions on the housing, wherein the first side portion has a first receptacle thereon and the second side portion has a second receptacle thereon, wherein the connector is removably attachable to either of the first and second receptacle after the line is attached to the proximate object.

20. The method of claim 19, further comprising the step of providing a first outlet on the first side portion and a second outlet on the second side portion, wherein the distal end of the line is selectively extendable outwardly through either of the first and said second outlet.

21. The method of claim 20, further comprising the step of providing a second aperture on the first side portion and a third aperture on the second side portion, and extending a portion of the spindle through the second and third apertures so that the spindle can be turned by a hand of a user.

22. The method of claim 21, further comprising the step of providing a slot extending downwardly from the first aperture to a bottom portion of the housing so that the line can be selectively extended downwardly through the slot.

23. The method of claim 22, further comprising the step of providing a first pathway connecting the slot to the first outlet and a second pathway connecting the slot to the second outlet so that the line can be selectively extended outwardly through either of the first pathway and the first outlet, and the second pathway and the second outlet.

24. The method of claim 23, further comprising the step of disposing the first and second pathways between a downwardly extending overhanging lip on the front portion of the housing and an inner wall of the housing so that the first and second pathways together extend from the first outlet to the second outlet.

25. The method of claim 24, wherein the spring is a spiral spring.

26. The method of claim 25, further comprising the step of providing serrations on the spindle so that the spindle can be turned by the hand of the user.

27. The method of claim 26, wherein the distal end of the line is selectively extendable outwardly from the housing in a 360 degree arc around the housing and removably attached to the proximate object for stabilizing the firearm.

28. The method of claim 27, further comprising the step of selecting the firearm from the group consisting of a long gun, shotgun, rifle, handgun and crossbow.

* * * * *